US005378220A

United States Patent [19]

Bunn

[11] Patent Number: 5,378,220

[45] Date of Patent: Jan. 3, 1995

[54] METHOD OF CONSTRUCTING REUSABLE YARD WASTE CONTAINER

[76] Inventor: Robert W. Bunn, 10075 Fox Farm Rd., Dundee, Oreg. 97115

[21] Appl. No.: 143,184

[22] Filed: Oct. 26, 1993

[51] Int. Cl.[6] ..... B31B 29/86; B31B 29/90

[52] U.S. Cl. ..... 493/226; 493/254; 493/920; 493/926

[58] Field of Search ..... 493/194, 195, 196, 210, 493/226, 253, 254, 255, 920, 926, 933

[56] References Cited

U.S. PATENT DOCUMENTS

| | | | |
|---|---|---|---|
| 3,349,991 | 10/1967 | Kessler | 493/194 |
| 3,827,928 | 8/1974 | van de Gent | 493/226 |
| 3,988,970 | 11/1976 | Hanson et al. | 493/194 |
| 4,133,252 | 1/1979 | Eckstein et al. | 493/226 |
| 4,479,243 | 10/1984 | Derby et al. | 493/226 |
| 4,526,565 | 7/1985 | Hummel et al. | 493/196 |
| 4,692,134 | 9/1987 | dos Santos Copia | 493/196 |
| 4,759,742 | 7/1988 | Achelpohl | 493/254 |
| 4,798,572 | 1/1989 | La Fleur et al. | 493/226 |
| 4,861,170 | 8/1989 | Patriksson | 493/226 |
| 4,988,213 | 1/1991 | Mattle | 493/226 |

*Primary Examiner*—William E. Terrell
*Attorney, Agent, or Firm*—Chernoff, Vilhauer, et al.

[57] ABSTRACT

A reusable yard waste container has a four sided rectangular shell which is open at its top end and has a flat multi-layered bottom. Two opposed sides of the shell have medial fold lines which allow the container to be collapsed to a flat orientation where it can be folded into a small package for storage. Located on the sides normal to the folding sides are upper and lower handles which facilitate handling of the container when full and erecting it from its collapsed orientation. Pockets at the bottom of the container receive weights to prevent the container from blowing away when it is left after being emptied. Snaps permit the top of the container to be closed when it is full. The container is constructed by placing four inwardly facing folds in the side walls of an elongate hollow cylindrical shell to form a rectangular cross-section shell with two pair of opposed sides. Outwardly facing folds are placed in one pair of sides, which allows the shell to be collapsed with the unfolded sides in side-by-side adjacency and the folded sides sandwiched between them. The sides are then stitched together at one end of the shell so that when the shell is reexpanded the unfolded sides are folded inwardly and the folded sides are folded over themselves on top of the unfolded sides to form a three-ply flat bottom.

2 Claims, 3 Drawing Sheets

METHOD OF CONSTRUCTING REUSABLE YARD WASTE CONTAINER

BACKGROUND AND SUMMARY OF THE INVENTION

This invention relates to a reusable container for collecting and storing yard waste prior to its being picked up for recycling.

Yard waste, such as grass clippings, dead flowers, pruned branches, fallen leafs and the like have become a major disposal problem. As the landfills used for municipal waste become full, and available land for new landfills becomes scarce, many landfills refuse to accept yard waste. As a result, yard waste recycling centers where this material is reduced to a mulch have been established. While most of these centers require the material to be brought to the center, government agencies are now starting to establish curbside pickup for recyclable yard waste.

The containers which heretofore have been used for collecting and storing recyclable materials for curbside pickup do not work well for yard waste. First, they are designed for much heavier materials and thus are not nearly large enough for this use. In addition, they generally are made from a solid material and wet garden waste placed in them will mold while waiting pickup. Also, since most recyclable materials are collected continuously, the container is permanently in its open collection position rather than being collapsible for more compact storage. With yard waste, on the other hand, it is common to collect materials for a particular week's pickup at one time and, therefore, it is desirable that the container be collapsible to a more compact configuration for storage in between periods of use.

What is needed is a lightweight container made from a breathable material that is self-supporting in an upright orientation and yet is collapsible to a compact orientation for storing. Even though it must be collapsible and flexible enough for folding for compact storage, it must have a strong bottom which will not easily be worn out when the container is dragged on rough surfaces, such as concrete. In addition, it must be closeable for storage of the material when it has been filled, be easily moveable when in its upright position, and be easy to invert for dumping the stored material out of the container into a recycling truck. In addition, because of its light weight, it must include provisions for carrying weights to prevent it from being blown away when its contents are emptied into the recycling truck and it is left empty on the curbside. In addition, these weights must assist, or at least not detract, in its ability to be self supporting in an upright position and to be emptied when turned upside down.

While there are many prior art containers which provide some of these features, none would provide all of the features necessary to serve this particular purpose. Futerman, U.S. Pat. No. 4,948,265; Marino, U.S. Pat. No. 4,703,517; Sandeman, U.S. Pat. No. 4,207,937; Burr, U.S. Pat. No. 860,183 and Converse, U.S. Pat. No. 733,542 all provide flexible fabric containers which are self-supporting. In addition, Burr and Converse both provide handles at their bottoms which would facilitate their being emptied into a recycling vehicle. However, because these containers have the flat bottom necessary to be self-supporting, they are not readily closed and none of them can be collapsed and folded for ease of storage.

The subject invention overcomes the short-comings inherent in the prior art flexible containers when they are used for collecting and storing yard waste for recycling by providing a hollow, open top shell having side walls and a perpendicular bottom which are formed from a unitary sheet of material. The bottom is planar and includes multiple layers of the material.

The container is formed from a hollow, cylindrical shell which has inwardly facing folds placed longitudinally in it at four spaced-apart locations. The resulting shell, then, is rectangular in cross-section with first and second pairs of opposed sides. Outwardly facing fold lines are then formed medially in the first pair of sides which allows the shell to be collapsed so that the second pair of sides are adjacent to one another with the folded first pair of sides sandwiched between them. The overlaying sides are then interconnected along the bottom edge of the shell. When the shell is opened, the lower margins of the sides fold inwardly to form a multi-layer flat bottom which allows the container to be self-supporting in an upright position and wear resistant.

In a preferred embodiment of the invention, handles are located on the second pair of sides at the top and bottom of the bag to facilitate handling and opening of the container. In addition, pouches are placed on the bottom of the container next to the lower set of handles to receive weights to prevent the container from being blown away when empty. Since the weight pouches are on the bottom they help stabilize the container when it is in its upright position, further reinforce the bottom, and push the material out of the container when it is emptied.

The subject invention will be more readily understood upon consideration of the following detailed description of a preferred embodiment, taken in conjunction with the accompanying drawings.

PREFERRED EMBODIMENT OF THE INVENTION

Figure 1:
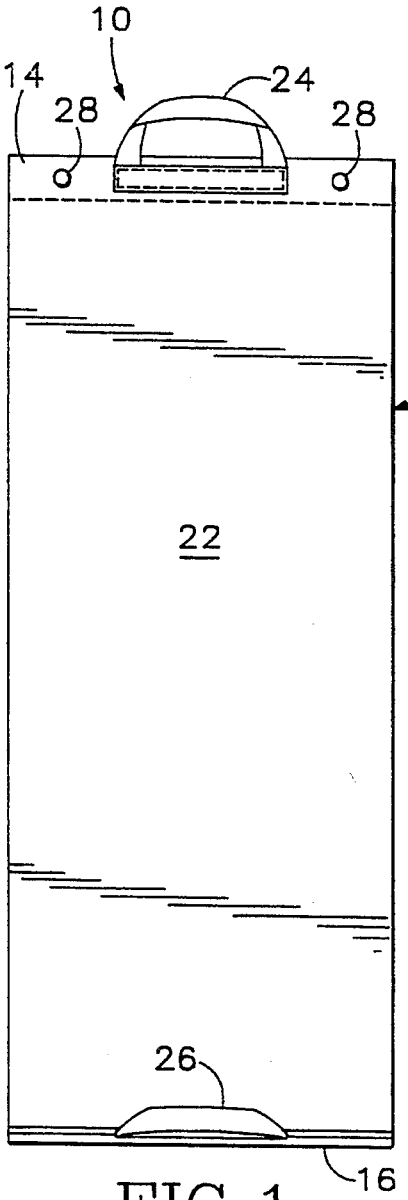
FIG. 1 is a front elevation view of a reusable yard waste container, embodying the subject invention, in its erected position.
Figure 2:
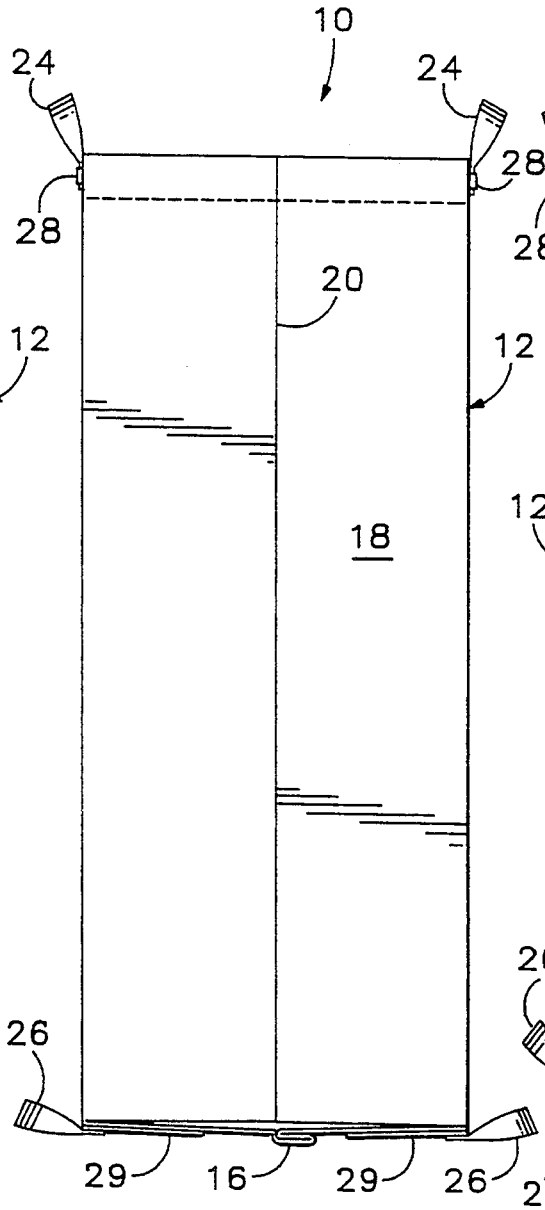
FIG. 2 is a side elevation view of the container of FIG. 1.
Figure 4:
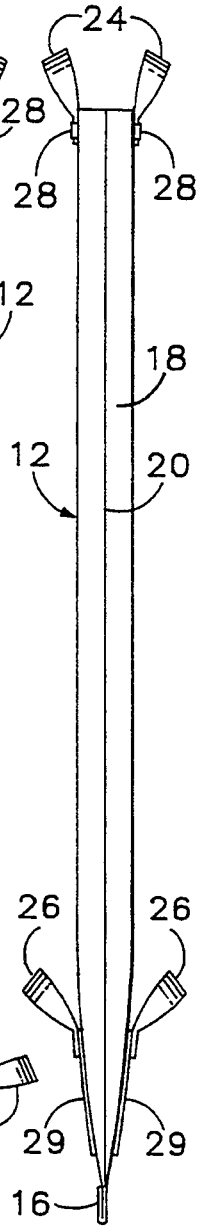
FIG. 4 is a side elevation view of the container of FIG. 1 in its collapsed position.
Figure 3:
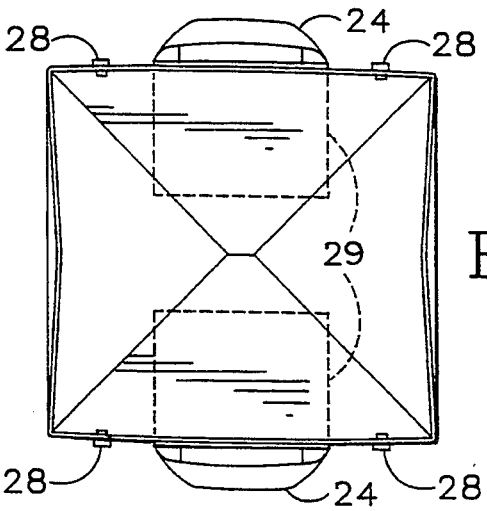
FIG. 3 is a plan view of the container of FIG. 1.

Referring now to FIGS. 1–4 of the drawings, a yard waste collection container 10 includes an elongate, rectangular, cross-sectioned hollow shell 12 which is open at its top end 14 and enclosed at its bottom end 16. The shell preferably is constructed from a durable, lightweight, wear resistant, breathable material which will permanently hold a crease. Woven polypropylene works well for this purpose. The shell has four planar sides oriented in opposed pairs. In the first pair of opposed sides 18, each side has an outwardly facing fold line 20 located medially in it over its entire longitudinal extent. The fold lines 20 permit the container to be collapsed from its erected position, FIGS. 1–3, to a folded position, FIG. 4, for storage. In the second pair of opposed sides 22, each side has an upwardly facing upper handle 24 located proximate the top end 14 and a downwardly facing lower handle 26 located proximate the bottom end 16. In addition, snaps 28 are located at the top end of the second pair of sides which allow the upper end to be closed. Located immediately below each lower handle 26 is a pouch 29 having a hook and loop fastener 30 which allows it to be opened and closed. Weights (not shown) can be placed in the pouches to assist in holding the container in an upright orientation and prevent it from being blown away after it has been emptied and left for later retrieval by the homeowner. As will be apparent from the description of the method of constructing the container which follows, the container has a flat multi-layer bottom when erected which allows it to stand in an upright position unsupported.

Figure 5:
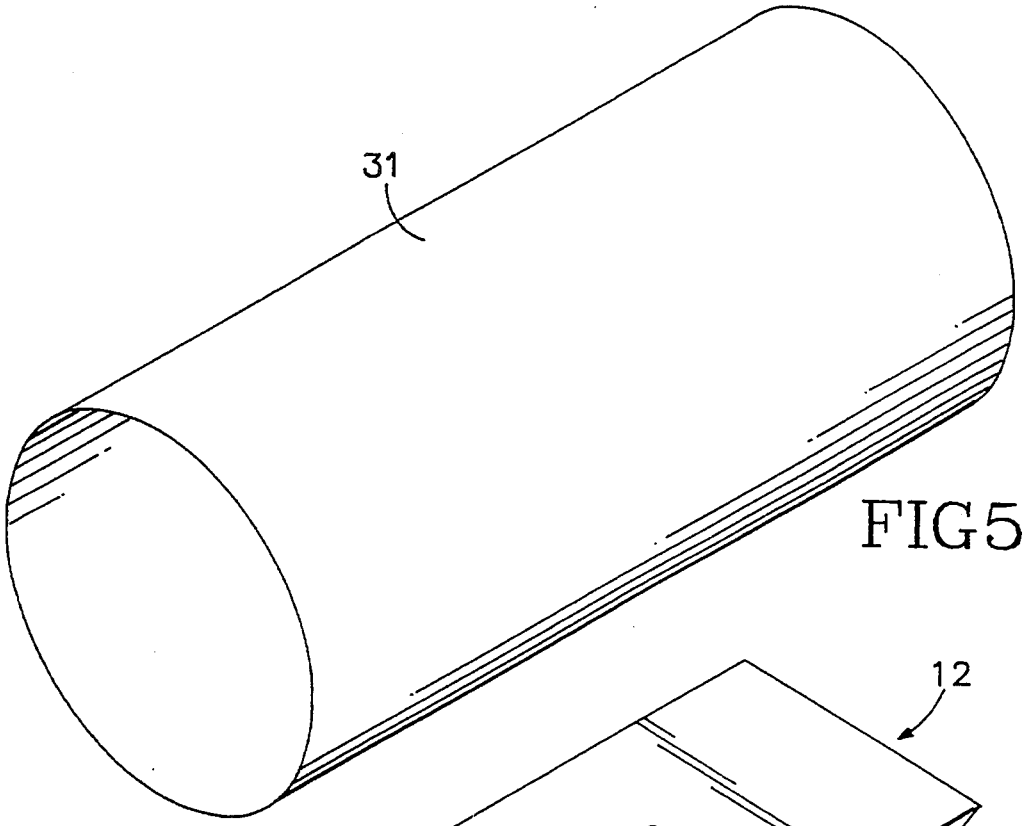
FIGS. 5–9 are perspective views showing the various steps of the method of constructing the container.
Figure 6:
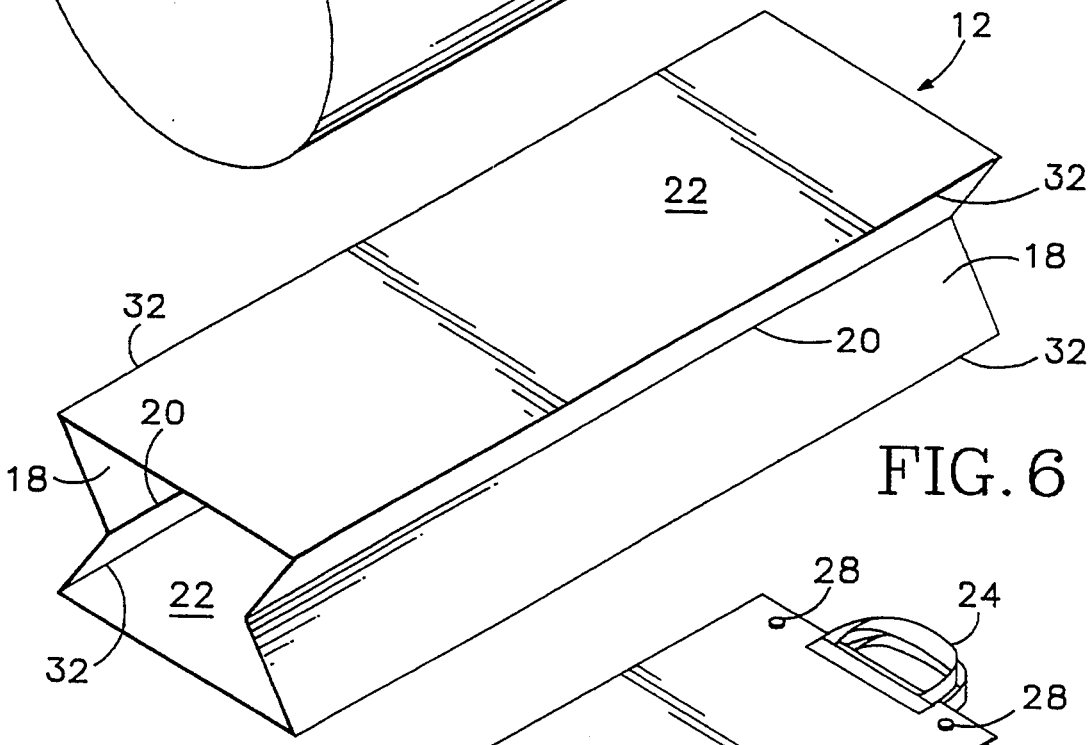
Figure 7:
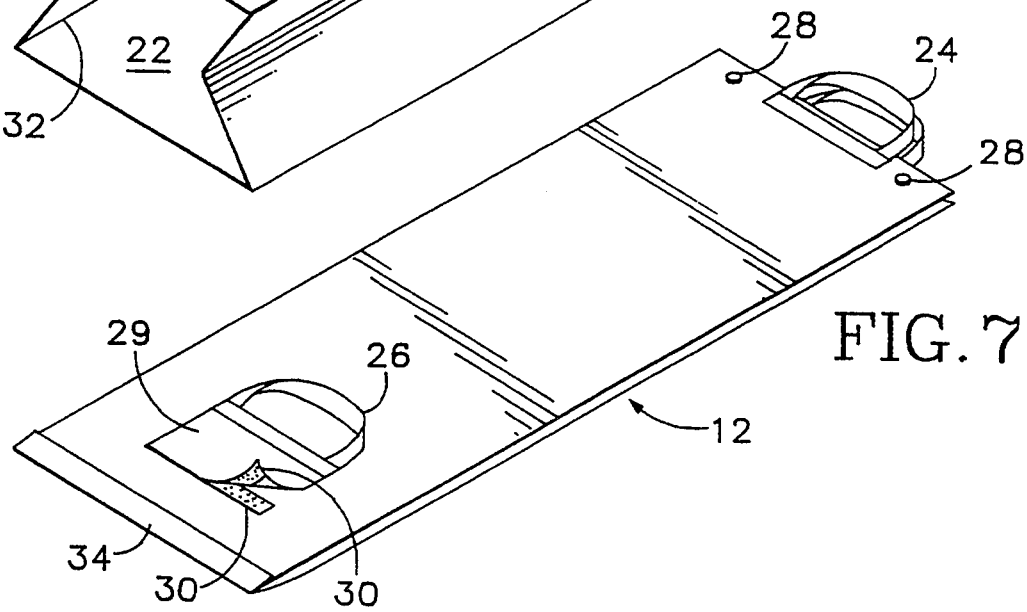

The shell is constructed from an open ended elongate hollow cylindrical tube 31, FIG. 5. Four inwardly facing fold lines 32 are placed in the tube parallel with its longitudinal axis in equi-spaced pairs. This creates the rectangular shape of the shell with the first and second sets of sides 18 and 22, respectively. The outwardly facing fold lines 20 are then placed medially in the first set of sides which allows the shell to be collapsed, FIG. 6. While collapsed, the bottom margin 34 of the shell is folded over and stitched to interconnect the first pair of sides 22 and the folded second pair of sides 18. The upper and lower handles 24, 26, the pouches 29, and snaps 28 are then attached to the shell, FIG. 7. This completes the construction of the container, which now is in its collapsed orientation.

Figure 8:
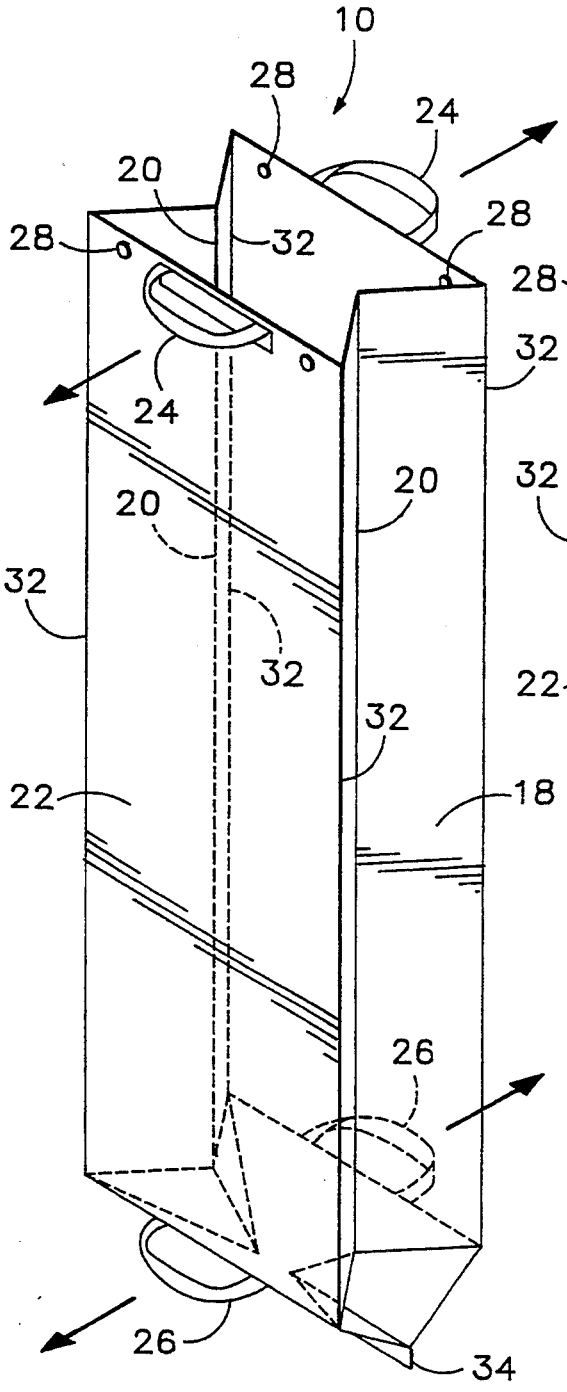
Figure 9:
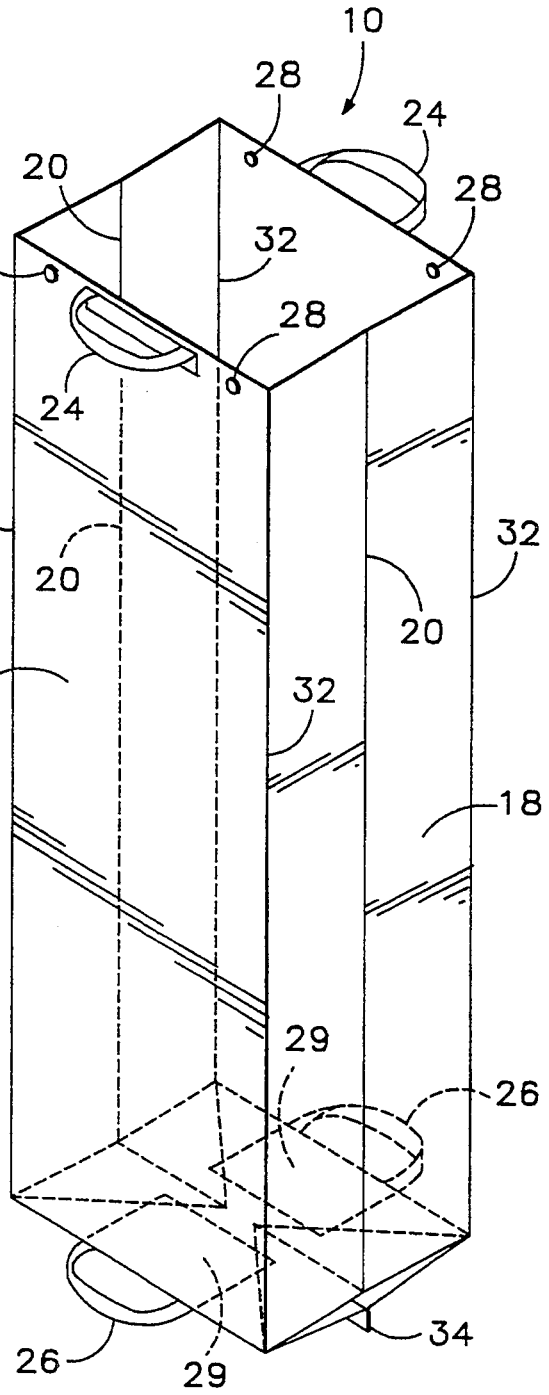

Referring to FIGS. 8 and 9, the container is expanded to its erected position by pulling the upper handles 24 away from one another and then pulling the lower handles 26 away from one another, or vice versa. As can be seen in the drawings, this causes the lower margins of the second pair of sides 22 to be folded inwardly and create an outer element of the bottom of the container. At the same time, the lower margins of the first pair of sides 18 are folded over themselves to form a double-ply inner bottom element. Thus, as can be seen in FIG. 9, a flat, three-ply, rectangular bottom is formed which permits the container to be supported in an upright position for receiving yard waste. In addition, since the pouches 29 are located at the bottom of the container they help reinforce the bottom and the weights in them help support the container in the upright position. The folded bottom margin 34 is folded 90 degrees when the container is placed on its bottom.

When the container is filled, the snaps 28 at the top of the shell are fastened and the container can be used to store the collected material until it is picked up for recycling. The container is emptied by unfastening the snaps, inverting the container and holding it by the lower handles 26 in the inverted position and shaking the material out. The weight in the pouches 29 causes the bottom to bulge inwardly when the container is inverted and thus push the material out of the container. The container is then collapsed and, if desired, folded into a compact flat orientation for storage.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for making a reusable fabric container for storing yard waste and the like for collection, said method comprising:

(a) providing a unitary elongate hollow cylindrical shell which is open at each end;

(b) creating inwardly facing folds in said shell at four spaced-apart locations parallel with the longitudinal axis of said shell so as to create a rectangular cross-section with first and second pairs of opposed planar sides;

(c) creating outwardly facing folds in said shell parallel with the longitudinal axis thereof midway in said first pair of opposed sides;

(d) thereafter collapsing said shell along said outwardly facing folds so as to bring said second pair of sides into adjacency with one another with said first pair of sides folded therebetween;

(e) interconnecting said adjacent second pair of sides and said folded first pair of sides along one end of said shell;

(f) placing lower handles in each of said second pair of sides;

(g) placing upper handles in each of said second pair of sides; and (h) thereafter reopening said shell along said outwardly facing fold line back to said rectangular cross-section as so to create a planar multi-layer bottom from the lower margins of said sides which is generally perpendicular with the remainder of said sides and which comprises two layers from said first pair of sides and one layer from said second pair of sides.

2. The method claim of claim 1 including the step of placing pockets in each of said second pair of sides proximate said lower handles prior to step (h).

* * * * *